US008955631B2

(12) United States Patent
Nishimura

(10) Patent No.: US 8,955,631 B2
(45) **Date of Patent: *Feb. 17, 2015**

(54) HYDRAULIC EXCAVATOR

(71) Applicant: Komatsu Ltd., Tokyo (JP)

(72) Inventor: Minetaka Nishimura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/997,376

(22) PCT Filed: Nov. 13, 2012

(86) PCT No.: PCT/JP2012/079381

§ 371 (c)(1),
(2) Date: Jun. 24, 2013

(87) PCT Pub. No.: WO2014/076760

PCT Pub. Date: May 22, 2014

(65) Prior Publication Data

US 2014/0133946 A1 May 15, 2014

(51) Int. Cl.
*E02F 9/22* (2006.01)
*E02F 9/08* (2006.01)

(52) U.S. Cl.
CPC ..... *E02F 9/0858* (2013.01); *E02F 9/0833* (2013.01)
USPC ..... 180/89.1; 180/68.1; 37/347; 37/379; 37/381; 37/443

(58) Field of Classification Search
CPC ..... E02F 1/00; E02F 3/00; E02F 5/00; E02F 9/00; E02F 9/264; E02F 9/267; H01Q 1/3275
USPC ..... 180/89.13, 68.1, 312; 37/347, 379, 381, 37/443
See application file for complete search history.

(56) References Cited

U.S. PATENT DOCUMENTS

| | | | | |
|---|---|---|---|---|
| 7,780,213 | B2 * | 8/2010 | Kim | 296/37.6 |
| 2004/0148815 | A1 * | 8/2004 | Chikaishi et al. | 37/347 |
| 2005/0210718 | A1 * | 9/2005 | Ueda et al. | 37/466 |
| 2009/0049718 | A1 * | 2/2009 | Tanaka | 37/443 |
| 2009/0084004 | A1 * | 4/2009 | Kim | 37/466 |
| 2010/0034421 | A1 * | 2/2010 | Roberts et al. | 382/100 |
| 2010/0206927 | A1 * | 8/2010 | Noda et al. | 224/401 |
| 2012/0068432 | A1 * | 3/2012 | Tanaka et al. | 280/163 |

FOREIGN PATENT DOCUMENTS

| | | | |
|---|---|---|---|
| JP | 2002322676 | A | * 11/2002 |
| JP | 2004-238879 | A | 8/2004 |
| JP | 2007-327190 | A | 12/2007 |
| JP | 2008-102097 | A | 5/2008 |

* cited by examiner

*Primary Examiner* — Paul N Dickson
*Assistant Examiner* — Darlene P Condra
(74) *Attorney, Agent, or Firm* — Global IP Counselors, LLP

(57) ABSTRACT

A hydraulic excavator basically includes a lower traveling unit, an upper revolving unit, a counterweight, a machine compartment, a first handrail, a second handrail and a pair of antenna supporting parts. The upper revolving unit is revolvably mounted on the lower traveling unit. The counterweight is disposed on the upper revolving unit. The machine compartment is disposed in front of the counterweight on the upper revolving unit. The first and second handrails are disposed on the machine compartment. The antenna supporting parts are configured to support a pair of antennas. The antenna supporting parts are respectively connected to the first and second handrails.

17 Claims, 5 Drawing Sheets

HYDRAULIC EXCAVATOR

CROSS-REFERENCE TO RELATED APPLICATIONS

This application is a U.S. National stage application of International Application No. PCT/JP2012/079381, filed Nov. 13, 2012.

BACKGROUND

1. Field of the Invention

The present invention relates to a hydraulic excavator that can be equipped with a GNSS antenna.

2. Background Information

A hydraulic excavator equipped with an antenna for a Real Time Kinematic-Global Navigation Satellite System (RTK-GNSS) is known in the prior art (e.g., see Japanese Patent Laid-open No. 2008-102097). The antenna is installed on a counterweight.

SUMMARY

However, when the antenna is placed on the counterweight, the workability for attaching and removing the antenna is low because the operator is required to conduct work on top of the counterweight when attaching or removing the antenna.

An object of the present invention is to provide a hydraulic excavator that allows for improved workability when attaching and removing an antenna.

A hydraulic excavator according to a first embodiment of the present invention comprises a lower traveling unit, an upper revolving unit, a counterweight, a machine compartment, a passage, and a pair of antenna supporting parts for supporting a pair of antennas. The upper revolving unit is rotatably mounted on the lower traveling unit. The counterweight is disposed on the upper revolving unit. The machine compartment is disposed in front of the counterweight on the upper revolving unit. The passage is formed on the machine compartment. The pair of antenna supporting parts is disposed above the passage. The pair of antenna supporting parts is positioned near the outer edge of the passage when viewed from above.

According to the hydraulic excavator according to the first embodiment of the present invention, since the operator is able to conduct work to attach and remove the pair of antennas, the workability of attaching and removing the pair of antennas can be improved.

The hydraulic excavator according to a second embodiment of the present invention is related to the first embodiment, and includes a pair of handrails disposed on the machine compartment along the outer edge of the passage. The pair of antenna supporting parts is connected to the pair of handrails.

According to the hydraulic excavator according to the second embodiment of the present invention, there is no need to provide a separate member for supporting the pair of antenna supporting parts.

The hydraulic excavator according to a third embodiment of the present invention is related to the first embodiment, and further comprises a pair of handrails disposed on the machine compartment. The pair of antenna supporting parts is a portion of the pair of handrails.

According to the hydraulic excavator according to the third embodiment of the present invention, there is no need to provide a separate member for supporting the pair of antenna supporting parts.

The hydraulic excavator according to a fourth embodiment of the present invention is related to the second embodiment, wherein the pair of handrails is disposed on the left and right relative to a center line in the front-rear direction.

According to the hydraulic excavator according to the fourth embodiment of the present invention, positional coordinates of the hydraulic excavator can be calculated with high precision on the basis of position information of the pair of antennas since the pair of antennas is disposed away from each other to the right and left relative to the center line.

A hydraulic excavator according to a fifth embodiment of the present invention is related to the second to fourth embodiments, and the pair of antenna supporting parts is positioned on a side opposite to the passage relative to the pair of handrails when viewed from above.

According to the hydraulic excavator according to the fifth embodiment of the present invention, an operator can recognize that the pair of antenna supporting parts is not a handrail. Therefore, there is no need to improve the strength of the pair of antenna supporting parts as much as the handrails.

The hydraulic excavator according to a sixth embodiment of the present invention is related to the first to fifth embodiments, and further comprises a pair of antennas removably attached to the pair of antenna supporting parts.

According to the hydraulic excavator according to the sixth embodiment of the present invention, the operator can easily attach or detach the pair of antennas at the start or completion of work.

A hydraulic excavator according to a seventh embodiment of the present invention is related to the first to sixth embodiments, and the machine compartment includes an engine compartment disposed in front of the counterweight, and an equipment compartment disposed in front of the engine compartment The passage is formed on the equipment compartment.

According to the hydraulic excavator according to the seventh embodiment of the present invention, in comparison to a case in which the passage is formed on the engine compartment, the pair of antennas can be disposed closer to the revolving center of the upper revolving unit As a result, the positional coordinates of the hydraulic excavator can be calculated with high precision on the basis of position information of the pair of antennas.

According to the present invention, a hydraulic excavator can be provided that allows for improved workability when attaching and removing the antenna.

DETAILED DESCRIPTION OF EMBODIMENTS

Figure 1:
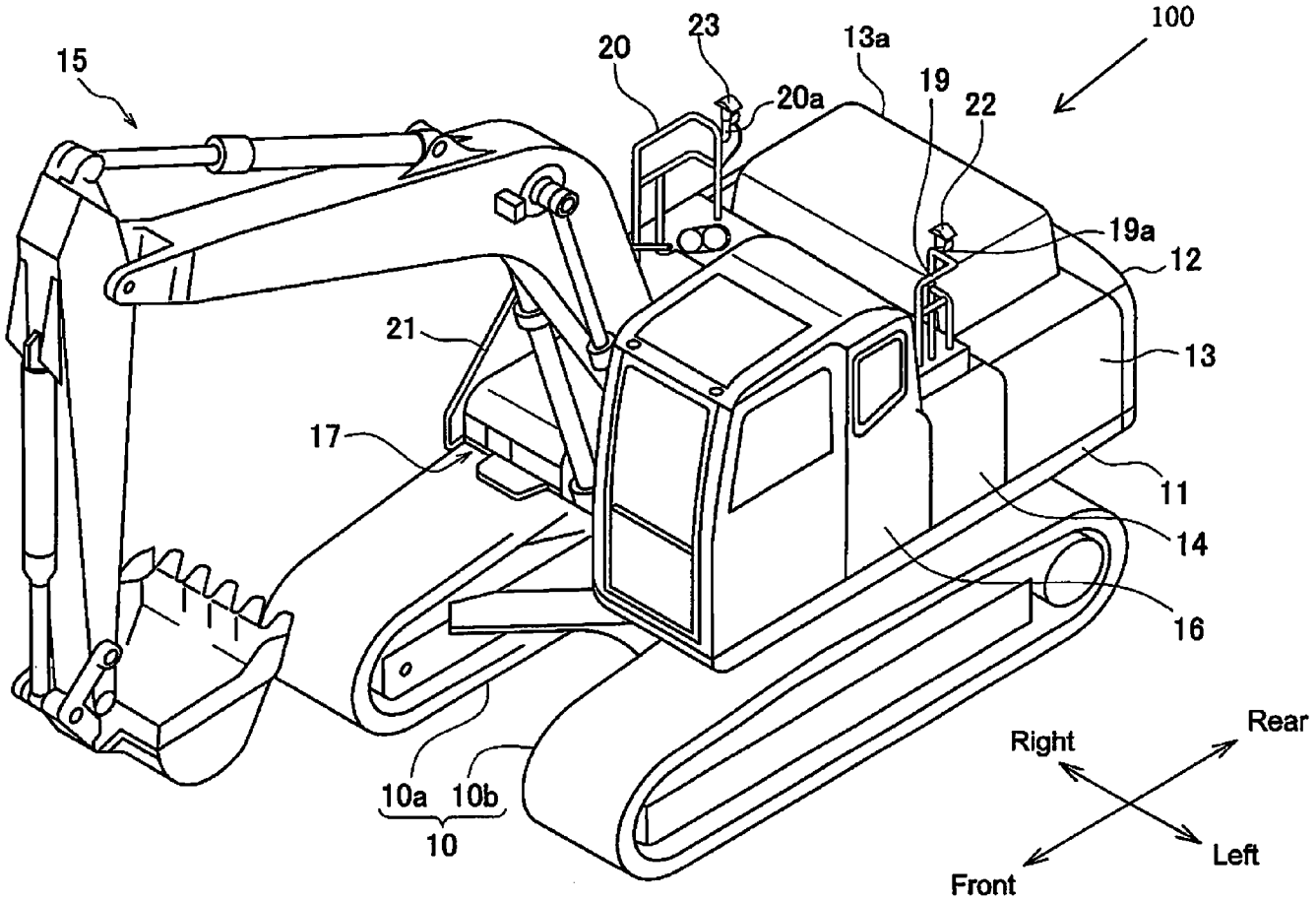
FIG. 1 is a frontal perspective view of a hydraulic excavator.

Next, an embodiment of the present invention will be explained with reference to the drawings. In the following description of the drawings, identical or similar parts are given identical or similar reference numerals. However, the drawings are schematic and dimensional ratios and the like may differ from the actual objects. Therefore, detailed dimensions and the like should be determined in consideration of the following drawings. Moreover, it is needless to say that parts with mutually different dimensional relationships or ratios are included in mutual relationships in the drawings.

In the following description, "up," "down," "front," "rear," "left," and "right" are terms used on the basis of an operator sitting in an operator's seat.

Figure 2:
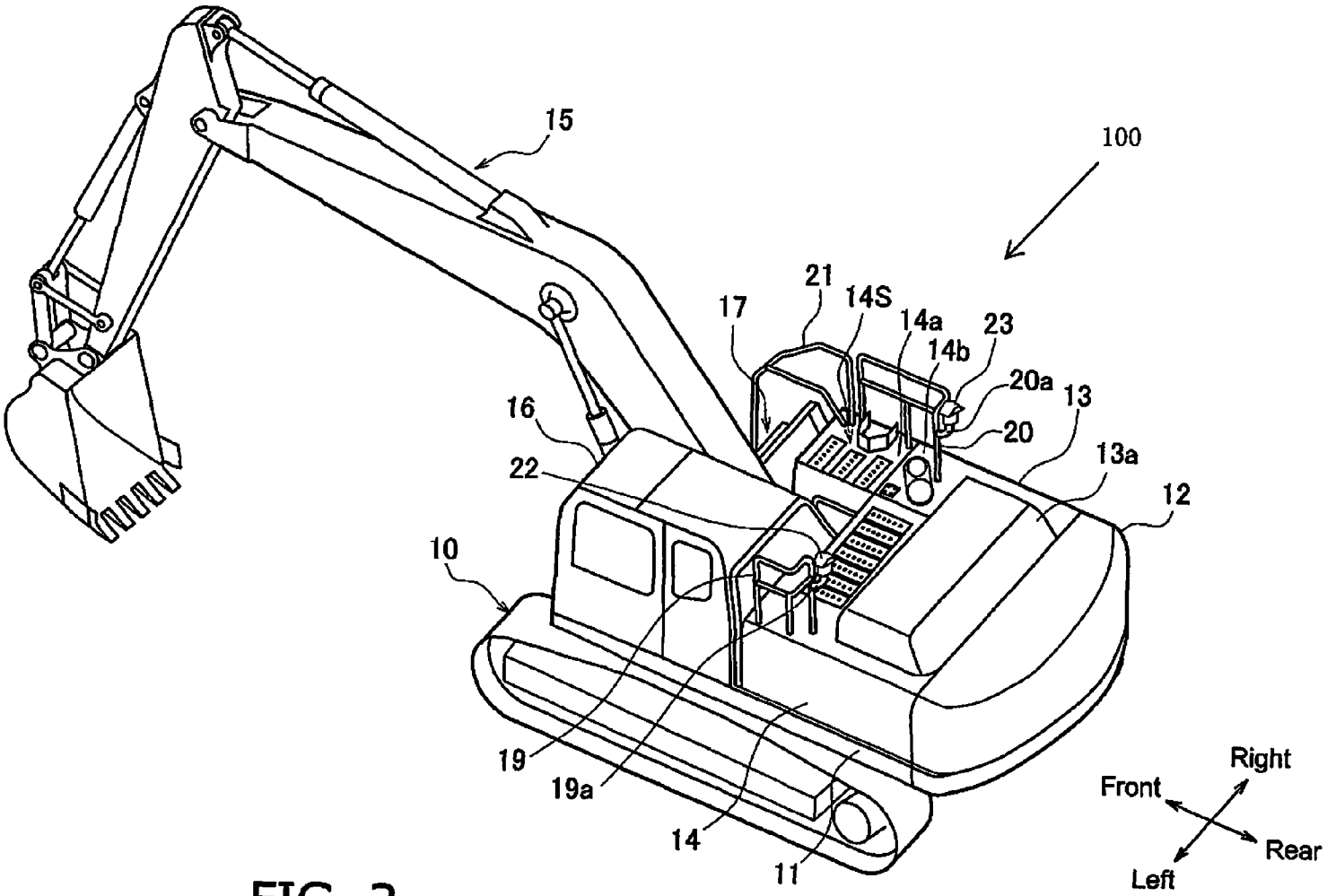
FIG. 2 is a rear perspective view of the hydraulic excavator.

A configuration of a hydraulic excavator 100 according to an embodiment shall be explained in detail with reference to the drawings. FIG. 1 is a front perspective view of the hydraulic excavator 100. FIG. 2 is a rear perspective view of the hydraulic excavator 100.

The hydraulic excavator 100 includes a lower traveling unit 10, an upper revolving unit 11, a counterweight 12, an engine compartment 13, an equipment compartment 14, work implement 15, a cab 16, a steps 17, a first handrail 19, a second handrail 20, a third handrail 21, a first GNSS antenna 22, and a second GNSS antenna 23.

The lower traveling unit 10 includes a pair of rotatable crawlers 10*a*, 10*b* that operate independently of each other. The hydraulic excavator 100 moves back and forth and left and right by rotating the pair of crawlers 10*a*, 10*b*.

The upper revolving unit 11 is mounted in a rotatable manner on the lower traveling unit 10. The upper revolving unit 11 constitutes the vehicle body frame of the hydraulic excavator 100. The counterweight 12, the equipment compartment 14, the engine compartment 13, and the cab 16 are disposed on the upper revolving unit 11

The counterweight 12 is disposed on the rearmost side of the upper revolving unit 11. The counterweight 12 is formed by inserting waste steel or concrete into a box assembled from steel plates. The counterweight 12 is used to maintain balance while doing excavation work and the like.

The engine compartment 13 is disposed on the upper revolving unit 11. The engine compartment 13 is disposed in front of the counterweight 12. The engine compartment 13 is disposed behind the equipment compartment 14. The engine compartment 13 accommodates an engine and an exhaust gas treatment device and the like that are not illustrated in the drawings. An engine hood 13 that can be opened and closed is disposed above the engine compartment 13. The operator can stand on a passage 18 and open the engine hood 13 when conducting maintenance inside the engine compartment 13.

The equipment compartment 14 is disposed between the engine compartment 13 and the work implement 15 on the upper revolving unit 11. The equipment compartment 14 includes a fuel tank 14*a* and an operating fluid tank 14*b*. In the present embodiment, an upper surface 14S of the equipment compartment 14 is formed in an L shape as illustrated in FIG. 2.

In the present embodiment, the engine compartment 13 and the equipment compartment 14 constitute a machine compartment upon which the passage 18 is formed.

The work implement 15 is mounted in a swingable manner at the front side of the upper revolving unit 11. The work implement 15 is disposed in front of the equipment compartment 14. The work implement 15 is supported by the upper revolving unit 11 between the cab 16 and the steps 17.

The cab 16 is disposed on the upper revolving unit 11. The cab 16 is provided in front of the equipment compartment 14 and to the left of the work implement 15 to allow the operator to view the movement of the work implement 15. An operator's seat in which the operator sits is provided inside the cab 16.

The steps 17 is disposed at the front right of the equipment compartment 14. The steps 17 are used for climbing up and down between the ground and the passage 18.

The passage 18 is formed on the equipment compartment 14. The passage 18 is a substantially flat area of the upper surface 14S of the equipment compartment 14. In other words, the passage 18 is an area where the operator can place his feet of the upper surface 14S of the equipment compartment 14. The passage 18 according to the present embodiment is formed in an L shape in accordance with the shape of the upper surface 14S of the equipment compartment 14. The configuration of the passage 18 is described below.

The first and second handrails 19, 20 are disposed on the equipment compartment 14. The first and second handrails 19, 20 are provided at the edges of the passage 18 and are used by the operator standing on the passage 18 to support his body. The first handrail 19 and the second handrail 20 are separated from each other in the left-right direction. Thus, the operator standing between the first handrail 19 and the second handrail 20 is able to open the engine hood 13*a* to conduct maintenance inside the engine compartment 13. The first handrail 19 is disposed on the left end of the equipment compartment 14. The second handrail 20 is disposed on the right end of the equipment compartment 14. The second handrail 20 is disposed on the fuel tank 14*a* and the operating fluid tank 14*b*.

In the present embodiment, both the first and second handrails 19, 20 take the form of an L shape when viewed from above. Specifically, one side of the L shape extends in the front-back direction along the both side edges of the upper revolving unit 11, and the other side of the L shape extends from the rear end of the one side toward the inside of the upper revolving unit 11.

A first antenna supporting part 19*a* is connected to the first handrail 19. The first antenna supporting part 19*a* is a bracket for attaching the first GNSS antenna 22. Similarly, a second antenna supporting part 20*a* is connected to the second handrail 20. The second antenna supporting part 20*a* is a bracket for attaching the second GNSS antenna 23. Disposition and configuration of the first and second antenna supporting parts 19*a*, 20*a* are explained below.

The third handrail 21 is disposed in front of the first handrail 19 and to the right of the steps 17. The third handrail 21 is used by the operator to support his body while ascending and descending the steps 17.

The first and second GNSS antennas 22, 23 are antennas used for a Real Time Kinematic-Global Navigation Satellite System (RTK-GNSS). The first and second GNSS antennas 22, 23 are disposed above the passage 18. "Above the passage 18" is a concept that includes, in addition to the space vertically above the passage 18, a surrounding space near the space vertically above the passage 18. The first GNSS antenna 22 is attached to the first antenna supporting part 19*b* of the first handrail 19. The second GNSS antenna 23 is attached to the second antenna supporting part 20*b* of the second handrail 20.

Figure 3:
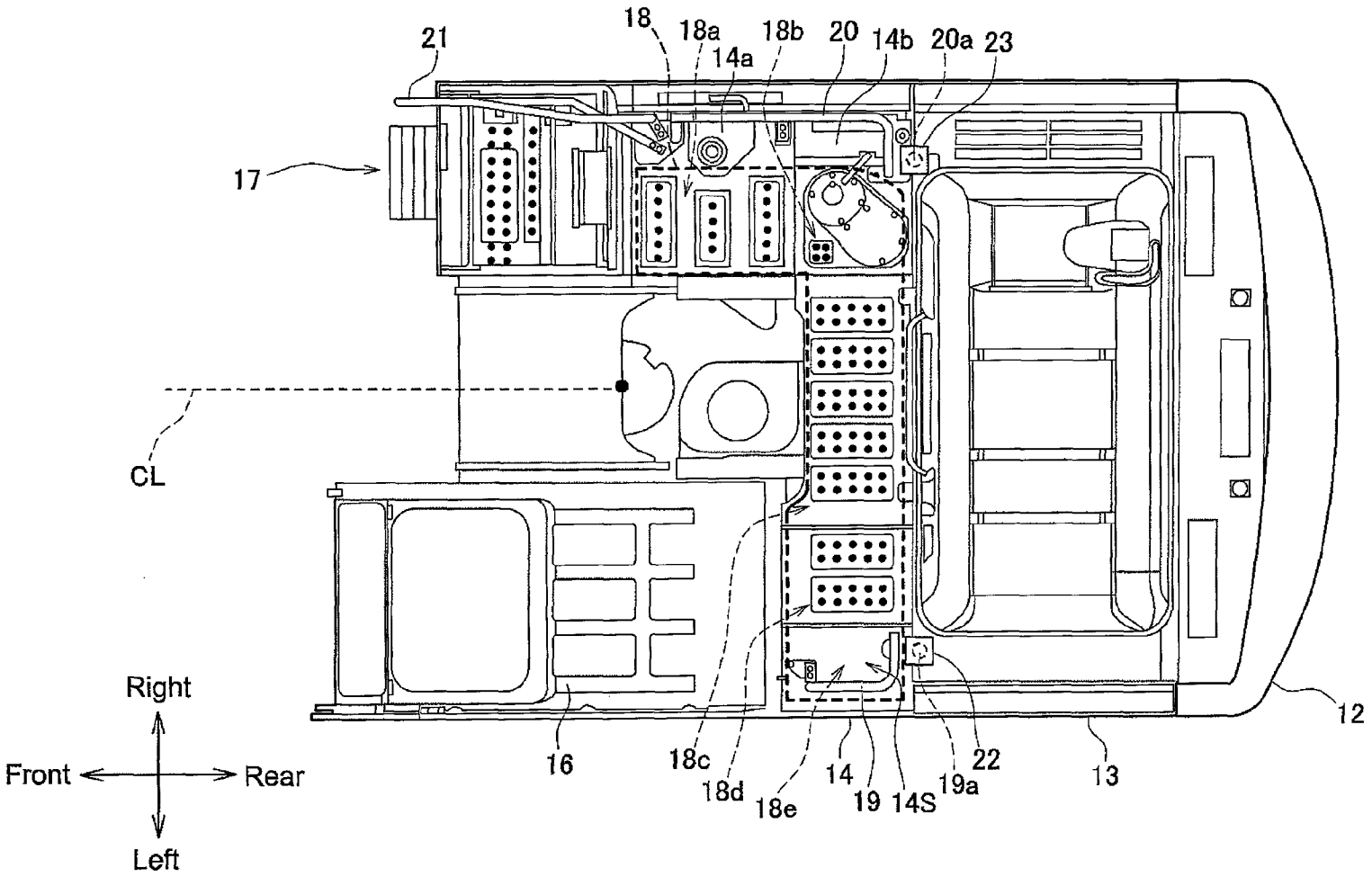
FIG. 3 is a top view of an equipment compartment.

Next, the disposition of the first and second antenna supporting parts 19*a*, 20*a* is described with reference to the drawing. FIG. 3 is a top view of the equipment compartment 14.

First, the configuration of the passage 18 will be described with reference to FIG. 3.

The passage 18 includes a first passage section 18*a*, a second passage section 18*b*, a third passage section 18*c*, a fourth passage section 18*d*, and a fifth passage section 18*e*.

The first passage section 18*a* is formed to the rear of the steps 17. The first passage section 18*a* is formed on the upper surface of the fuel tank 14*a* on the upper surface 14S. The second passage section 18*b* is formed to the rear of the first passage section 18*a*. The second passage section 18*b* is formed on the upper surface of the operating fluid tank 14*b* on the upper surface 14S. The third passage section 18*c* is formed to the left of the second passage section 18*b*. The fourth passage section 18*d* is formed to the left of the third passage section 18*c*. The fifth passage section 18*e* is formed to the left of the fourth passage section 18*d*. In this way, the first and second passage sections 18*a*, 18*b* extend in the front-back direction, and the second to fifth passage sections 18*b* to 18*e* are aligned in a row in the left-right direction. Therefore, the entire passage 18 forms an L shape.

A non-slip treatment is applied to the surface of the first to fourth passage sections 18*a* to 18*d*. Specifically, a plurality of half-spherical protrusions is formed on the surface of the first to fourth passage sections 18*a* to 18*d*. In the present embodiment, the non-slip treatment is not applied to the fifth passage section 18*e*, but the non-slip treatment may also be applied to the fifth passage section 18*e*.

Next, the configuration of first and second handrails 19, 20 is described with reference to FIG. 3.

The first handrail 19 is disposed along the outer edge of the first and second passage sections 18*a*, 18*b*. The second handrail 20 is disposed along the outer edge of the fifth passage section 18*e*. The first and second handrails 19, 20 are disposed away from each other relative to a center line CL in the front-rear direction of the hydraulic excavator 100, as shown in FIG. 3.

Next, the installation positions of the first and second antenna supporting parts 19*a*, 20*a* are described with reference to FIG. 3.

The first and second antenna supporting parts 19*a*, 20*a* are positioned near the outer edge of the passage 18 when viewed from above. Specifically, the first antenna supporting part 19*a* is adjacent to the fifth passage section 18*e* of the passage 18. The second antenna supporting part 20*a* is adjacent to the second passage section 18*b* of the passage 18.

The first and second antenna supporting parts 19*a*, 20*a* are respectively positioned to the rear of the first and second handrails 19, 20. Therefore, the first and second antenna supporting parts 19*a*, 20*a* are positioned to the rear of the passage 18.

The first and second antenna supporting parts 19*a*, 20*a* are disposed away from each other relative to the center line CL in the front-rear direction, as shown in FIG. 3. The first and second antenna supporting parts 19*a*, 20*a* according to the present embodiment are positioned symmetrically on the right and left relative to the center line CL.

The first and second antenna supporting parts 19*a*, 20*a* are positioned on a boundary line between the engine compartment 13 and the equipment compartment 14. However, the first and second GNSS antennas 22, 23 only need to be positioned near the outer edge of the passage 18, the first and second GNSS antennas 22, 23 may be positioned above the engine compartment 13 or the equipment compartment 14 in the vertical direction.

Since the first and second GNSS antennas 22, 23 are respectively attached to the first and second antenna supporting parts 19*a*, 20*a*, the disposition of the first and second GNSS antennas 22, 23 are the same as the disposition of the abovementioned first and second antenna supporting parts 19*a*, 20*a*.

Next, the configuration of the first and second antenna supporting parts 19*a*, 20*a* is explained with reference to the drawings. The following is an explanation of the configuration of the second antenna supporting part 20*a* since the first and second antenna supporting parts 19*a*, 20*a* have the same configuration.

Figure 4:
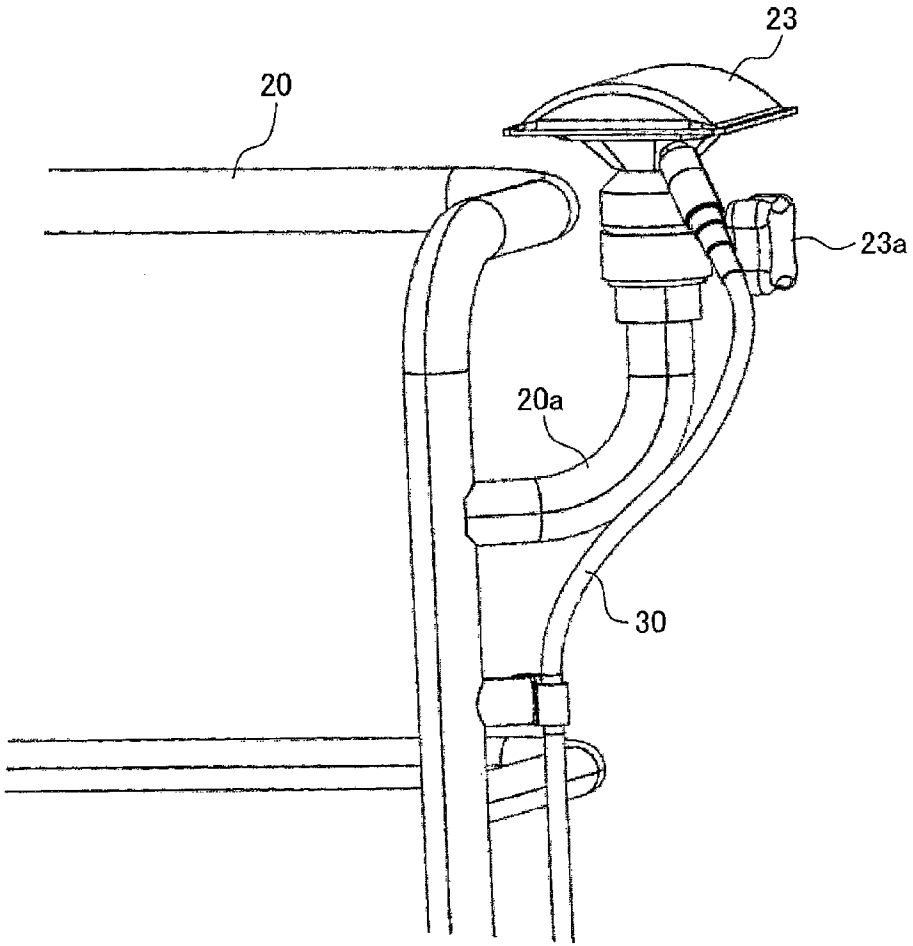
FIG. 4 illustrates a configuration of the pair of antenna supporting parts.
Figure 5:
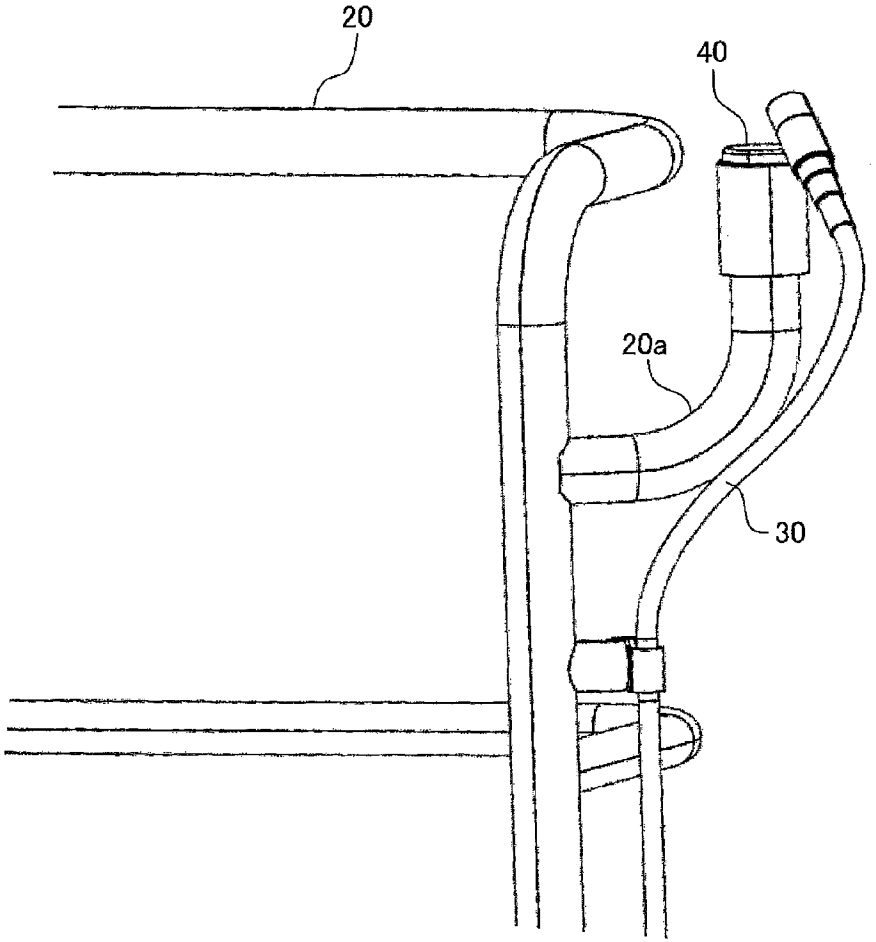
FIG. 5 illustrates a configuration of the pair of antenna supporting parts.

FIG. 4 illustrates a condition in which the second GNSS antenna 23 is attached to the second antenna supporting part 20*a*. FIG. 5 illustrates a condition in which the second GNSS antenna 23 is removed from the second antenna supporting part 20*a*.

The second antenna supporting part 20*a* is a bracket configured by a circular tube bent into an L shape. The second antenna supporting part 20*a* extends backward and upward from the rear part of the second handrail 20. The second antenna supporting part 20*a* is disposed on the side opposite to the passage 18 with the second handrail 20 interposed therebetween since the passage 18 is in front of the rear part of the second handrail 20. Since the first and second GNSS antennas 22, 23 are to the outside of the passage with the handrail interposed therebetween due to this disposition, unexpected contact with the first and second GNSS antennas 22, 23 due to someone moving along the passage can be avoided. The height of the second antenna supporting part 20*a* is preferably similar to that of the second handrail 20.

As illustrated in FIG. 4, the second GNSS antenna 23 is disposed on the second antenna supporting part 20*a*. The second GNSS antenna 23 is preferably disposed in a position higher than the second handrail 20 in order to properly receive GNSS satellite radio waves. The second GNSS antenna 23 has a knob 23*a* for connecting the second GNSS antenna 23 to the second antenna supporting part 20*a*. A cable 30 for transmitting position information to a controller is connected to the second GNSS antenna 23.

The second GNSS antenna 23 is preferably disposed in a position higher than the upper surface of the cab 16 in order to properly receive GNSS satellite radio waves.

As illustrated in FIG. 5, a cap 40 is fitted onto the second antenna supporting part 20*a* when the second GNSS antenna 23 is removed.

The first and second antenna supporting parts 19*a*, 20*a* (example of a pair of antenna supporting parts) in the present embodiment are positioned near the outer edge of the passage 18 when viewed from above.

Therefore, since the operator is able to conduct the work of attaching and removing the first and second GNSS antennas 22, 23 while standing on the passage 18, the workability for attaching and removing the first and second GNSS antennas 22, 23 is improved.

(2) The first and second antenna supporting parts 19*a*, 20*a* are respectively connected to the first and second handrails 19, 20.

Therefore, there is no need to provide separate members to support the first and second antenna supporting parts 19*a*, 20*a*.

(3) The first and second antenna supporting parts 19*a*, 20*a* are disposed on the right and left relative to the center line CL in the front-rear direction.

Therefore, the first and second GNSS antennas 22, 23 are disposed away from each other on the left and right relative to the center line CL. As a result, the positional coordinates of the hydraulic excavator 100 can be calculated with high precision on the basis of the position information of the first and second GNSS antennas 22, 23.

(4) The first and second antenna supporting parts 19*a*, 20*a* are positioned on the side opposite to the passage 18 relative to the first and second handrails 19, 20.

Therefore, the operator can recognize that the first and second antenna supporting parts 19*a*, 20*a* are not handrails. Thus, there is no need to improve the strength of the first and second antenna supporting parts 19*a*, 20*a* as much as the handrails.

(5) The first and second GNSS antennas 22, 23 (example of a pair of antennas) are removably attached to the first and second antenna supporting parts 19*a*, 20*a*.

Therefore, the operator is able to easily attach or remove the first and second GNSS antennas 22, 23 when starting or finishing work.

(6) The passage 18 is formed on the equipment compartment 14.

Therefore, the first and second GNSS antennas 22, 23 can be positioned closer to the revolving center of the upper revolving unit 11 than a case in which the passage is formed on the engine compartment 13. As a result, the positional coordinates of the hydraulic excavator can be calculated with high precision on the basis of position information of the first and second GNSS antennas 22, 23.

Other embodiments

While the present invention has been described with the embodiment provided above, the description and drawings form a portion of the disclosure and are not to be understood as limiting the invention. Various substitutions, embodiments, and operation techniques will be apparent to those skilled in the art.

While the passage 18 is formed on the equipment compartment 14 in the above embodiment, the present invention is not limited as such. The passage 18 may be formed on a "machine compartment" disposed on the upper revolving unit 11. Therefore, the passage 18 may be formed on the engine compartment 13, or may be formed on both the engine compartment 13 and the equipment compartment 14. Thus, the passage 18 is not required to take the form of an L shape, and is able to take the form of various shapes.

(B) While the "machine compartment" is described as being constituted by the engine compartment 13 and the equipment compartment 14 in the above embodiment, the present invention is not limited as such. The "machine compartment" may be a structure disposed in front of the counterweight 12 and structures other than the engine compartment 13 and the equipment compartment 14 may be included therein.

(C) While the first and second antenna supporting parts 19*a*, 20*a* are connected respectively to the pair of handrails 19, 20 in the above embodiment, the present invention is not limited as such. The first and second antenna supporting parts 19*a*, 20*a* may be connected directly to the equipment compartment 14 and the like.

(D) While the first and second antenna supporting parts 19*a*, 20*a* are positioned respectively to the rear of the first and second handrails 19, 20 in the above embodiment, the present invention is not limited as such. The first and second antenna supporting parts 19*a*, 20*a* may be respectively positioned in front of or to the side the first and second handrails 19, 20.

(E) While not discussed in particular on the above embodiment, the first and second antenna supporting parts 19*a*, 20*a* may overlap the outer edge of the passage 18 or may not overlap the outer edge of the passage 18 when viewed from above. "Near the outer edge of the passage 18" in the present description does not imply overlapping the outer edge of the passage 18.

(F) While the first and second antenna supporting parts 19*a*, 20*a* are described as being configured separately from the first and second handrails 19, 20 in the above embodiment, the first and second antenna supporting parts 19*a*, 20*a* may respectively be a portion of the first and second handrails 19, 20.

As described above, it is a matter of course that the present invention incorporates a variety of preferred embodiments which are not described herein. Hence the technical scope of the present invention is defined only by matters to define the invention, which are according to the scope of claims, reasonable from the above description.

The present invention is useful in the field of hydraulic excavators since the work to attach and remove antennas can be improved according to the hydraulic excavator of the present invention.

What is claimed is:

1. A hydraulic excavator comprising:

a lower traveling unit;

an upper revolving unit revolvably mounted on the lower traveling unit;

a counterweight disposed on the upper revolving unit;

a machine compartment disposed in front of the counterweight on the upper revolving unit;

a passage extending left and right over a center line extending in the front-rear direction of the hydraulic excavator on the machine compartment; and first and second of antenna supporting parts disposed above the passage and configured to support first and second of antennas, the pair of antenna supporting parts being positioned near an outer edge of the passage as viewed from above, the first and second antenna supporting parts being disposed on the left and right relative to the center line.

2. The hydraulic excavator according to claim 1, further comprising:

first and second of handrails disposed on the machine compartment along the outer edge of the passage, the first and second antenna supporting parts being connected to the first and second handrails, respectively.

3. The hydraulic excavator according to claim 2, wherein the first and second handrails are disposed on the left and right relative to a center line in a front-rear direction of the hydraulic excavator.

4. The hydraulic excavator according to claim 3, wherein the first and second antenna supporting parts are positioned on a side opposite to the passage relative to the first and second handrails as viewed from above.

5. The hydraulic excavator according to claim 3, further comprising:

first and second antennas removably attached to the first and second antenna supporting parts, respectively.

6. The hydraulic excavator according to claim 3, wherein the machine compartment includes an engine compartment disposed in front of the counterweight, and an equipment compartment disposed in front of the engine compartment; and the passage is formed on the equipment compartment.

7. The hydraulic excavator according to claim 2, wherein the first and second supporting parts are positioned on a side opposite to the passage relative to the first and second handrails as viewed from above.

8. The hydraulic excavator according to claim 7, further comprising:

first and second antennas removably attached to the first and second antenna supporting parts, respectively.

9. The hydraulic excavator according to claim 7, wherein the machine compartment includes an engine compartment disposed in front of the counterweight, and an equipment compartment disposed in front of the engine compartment; and the passage is formed on the equipment compartment.

10. The hydraulic excavator according to claim 2, further comprising:

first and second antennas removably attached to the first and second antenna supporting parts, respectively.

11. The hydraulic excavator according to claims 2, wherein the machine compartment includes an engine compartment disposed in front of the counterweight, and an equipment compartment disposed in front of the engine compartment; and the passage is formed on the equipment compartment.

12. The hydraulic excavator according to claim 1, further comprising:

first and second of handrails disposed on the machine compartment, the first and second antenna supporting parts being a portion of the first and second handrails, respectively.

13. The hydraulic excavator according to claim 12, further comprising:

first and second antennas removably attached to the first and second antenna supporting parts, respectively.

14. The hydraulic excavator according to claim 12, wherein the machine compartment includes an engine compartment disposed in front of the counterweight, and an equipment compartment disposed in front of the engine compartment; and the passage is formed on the equipment compartment.

15. The hydraulic excavator according to claim 1, further comprising:

first and second antennas removably attached to the first and second antenna supporting parts, respectively.

16. The hydraulic excavator according to claim 15, wherein the machine compartment includes an engine compartment disposed in front of the counterweight, and an equipment compartment disposed in front of the engine compartment; and the passage is formed on the equipment compartment.

17. The hydraulic excavator according to claim 1, wherein the machine compartment includes an engine compartment disposed in front of the counterweight, and an equipment compartment disposed in front of the engine compartment; and the passage is formed on the equipment compartment.

* * * * *